US007121035B2

(12) United States Patent
Greer

(10) Patent No.: US 7,121,035 B2
(45) Date of Patent: Oct. 17, 2006

(54) SIGHT-PRESERVING, PARTIALLY SELF-CLEANING, DIVERGENT-AXIS CALIBER CONVERSION IN HANDGUNS

(76) Inventor: Dwight Greer, 33870 S. Wilhoit Rd., Molalla, OR (US) 97038

( * ) Notice: Subject to any disclaimer, the term of this patent is extended or adjusted under 35 U.S.C. 154(b) by 76 days.

(21) Appl. No.: 10/949,676

(22) Filed: Sep. 24, 2004

(65) Prior Publication Data

US 2006/0064914 A1 Mar. 30, 2006

(51) Int. Cl.
*F41A 21/10* (2006.01)

(52) U.S. Cl. ..... 42/77; 89/29

(58) Field of Classification Search ..... 42/25, 42/77; 89/14.8, 29
See application file for complete search history.

(56) References Cited

U.S. PATENT DOCUMENTS

| | | | | | |
|---|---|---|---|---|---|
| 580,924 | A | | 4/1897 | Browning | |
| 984,519 | A | | 2/1911 | Browning | |
| 1,070,582 | A | | 8/1913 | Browning | |
| 1,169,249 | A | | 1/1916 | Frommer | |
| 1,179,021 | A | * | 4/1916 | Mayer | 102/446 |
| 1,355,420 | A | | 10/1920 | Pederson | |
| 1,563,675 | A | | 12/1925 | Tansley | |
| 2,090,657 | A | | 8/1937 | Williams | |
| 2,337,021 | A | * | 12/1943 | Barbieri | 42/77 |
| 2,976,638 | A | * | 3/1961 | Owens | 42/77 |
| 3,362,095 | A | | 1/1968 | Byer | |
| 3,657,959 | A | | 4/1972 | Kart | |
| 3,771,415 | A | | 11/1973 | Into et al. | |
| 3,776,095 | A | | 12/1973 | Atchisson | |
| 4,127,056 | A | | 11/1978 | Kart | |
| 4,220,071 | A | | 9/1980 | Seiderman | |
| 4,253,377 | A | * | 3/1981 | Arnett | 89/163 |
| 4,459,774 | A | * | 7/1984 | Ferretti | 42/77 |
| 4,515,064 | A | | 5/1985 | Hohrein | |
| 4,580,484 | A | * | 4/1986 | Moore | 89/128 |
| 4,648,192 | A | | 3/1987 | Harness | |
| 4,735,009 | A | * | 4/1988 | Jett, Jr. | 42/77 |
| 4,907,362 | A | * | 3/1990 | Hobbie | 42/77 |
| 4,920,678 | A | | 5/1990 | Brown | |
| 4,930,238 | A | * | 6/1990 | Poff, Jr. | 42/16 |
| 4,955,157 | A | * | 9/1990 | Brighton et al. | 42/77 |
| H926 | H | | 6/1991 | Mahtook | |
| 5,046,275 | A | | 9/1991 | Brown | |
| 6,625,916 | B1 | * | 9/2003 | Dionne | 42/16 |

* cited by examiner

*Primary Examiner*—Michael J. Carone
*Assistant Examiner*—Bret Hayes

(57) ABSTRACT

A conversion kit for converting a semi-automatic or self-loading handgun of a certain caliber, such as a Colt .45, is modified to allow the use therein of cartridges of a different, usually smaller caliber, thus to allow less expensive training on the handgun, wherein only the barrel and magazine need to be replaced, the barrel having thereon a sliding extractor that cooperates with the original slide in the ejection and reloading of cartridges, and an off-axis bore adjusted to compensate for the difference in the reloading mechanism and the lesser rise of the handgun when firing the lower caliber ammunition, thereby allowing retention of the sighting, safety features, and mechanical functions of the original handgun while closely duplicating the original weight.

2 Claims, 10 Drawing Sheets

70
72
74
76
78
78
80
82
84
86
88
90
92
94
96
20
22
24
26
28
12
44

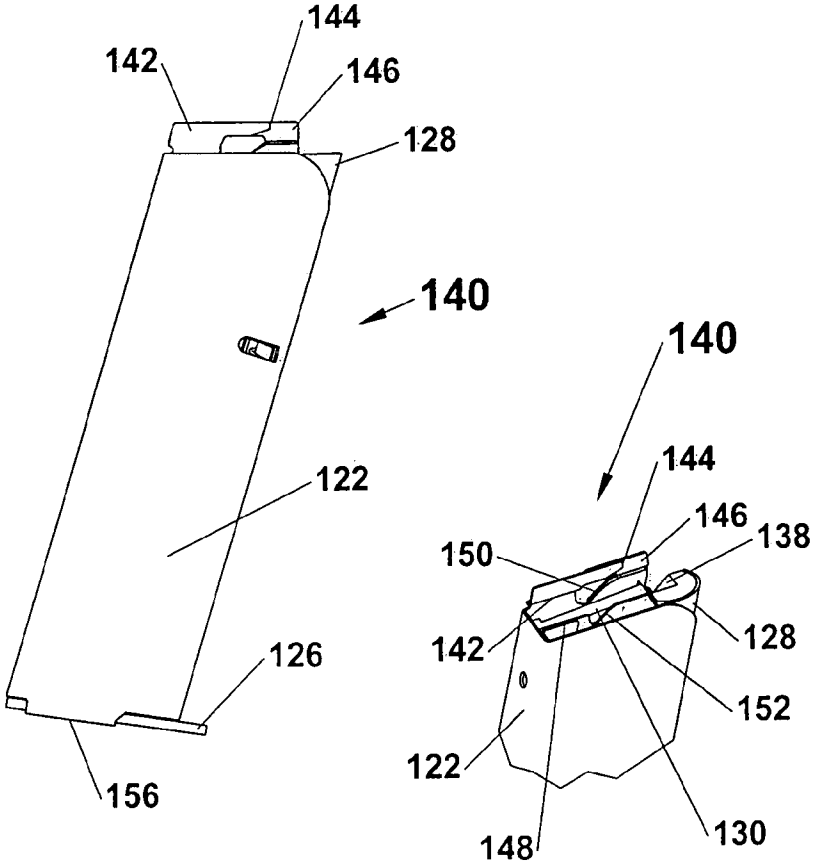
Fig. 19
Fig. 18
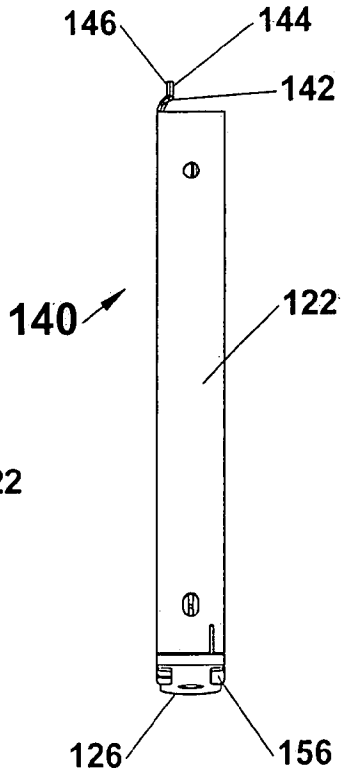
Fig. 17
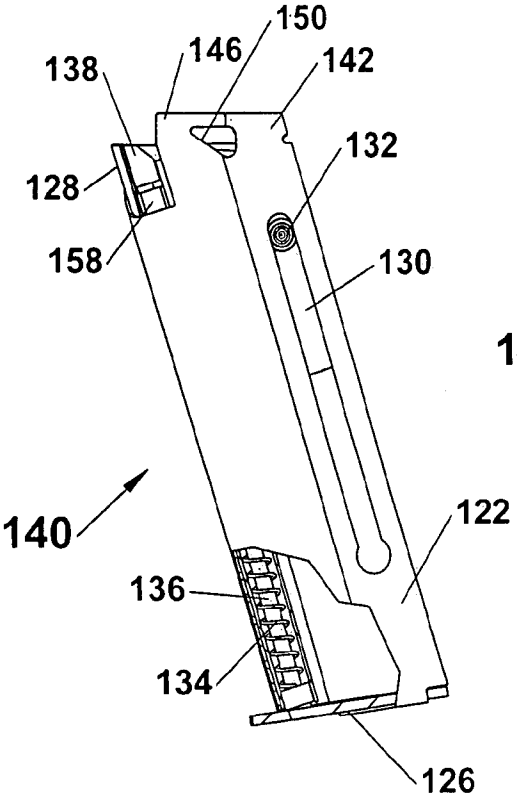
Fig. 16

SIGHT-PRESERVING, PARTIALLY SELF-CLEANING, DIVERGENT-AXIS CALIBER CONVERSION IN HANDGUNS

CROSS-REFERENCE TO RELATED APPLICATIONS

None

STATEMENT REGARDING FEDERALLY SPONSORED RESEARCH OR DEVELOPMENT

Not applicable

BACKGROUND OF THE INVENTION

1. Field of the Invention

This invention relates to weapons, and particularly to means for converting small arms weapons that use ammunition of a particular caliber into a version that will be usable for firing cartridges of a different, usually smaller caliber, while retaining the same original sighting characteristics at the completion of the conversion and without needing to replace the expensive original slide.

2. Background Information

In performing their duties, police officers, members of the military and the like generally employ small arms of relatively large caliber, such as .45 caliber. These weapons will also be of automatic or semi-automatic design, employing center fire, meaning that the firing pin will impinge on the shell along the central axis of the cartridge. Since such weapons have considerable power but are yet small in size, the amount of training required to master their proper use, particularly in achieving accurate and dependable aiming, is substantially greater than that required to learn, for example, the proper use of rifles or shotguns. With the smaller, hand held weapon, referred to hereinafter generally as a pistol, a handgun or simply a gun or firearm, skill in avoiding flinching due to the noise and recoil when the gun is fired must be acquired, specifically through learning the art of sight picturing and trigger squeeze. Such training requires spending considerable time in practice firing on a firing range, for which the ammunition required for the larger .45 caliber, 9 mm or similar sizes can be quite expensive.

For economic reasons, it would thus be useful to have a handgun of much the same size and weight, and having other features similar to the normal, large caliber handgun, but yet which fired smaller caliber and less expensive ammunition, and in fact efforts to make such adaptations have quite a long history as noted below and in the Information Disclosure Statement filed herewith. The cost of .22 caliber ammunition, for example, is only about 10% of the cost of 9 mm parabellum or .45 ACP ammunition. In order to avoid the purchase of a second handgun, it is thus a better method of decreasing costs, by easily reversible means, to convert a standard .45 or 9 mm handgun so as to fire .22 caliber ammunition. That procedure would preferably retain the weight and most of the other characteristics of the larger caliber weapon, whereby meaningful and useful practice with such a modified weapon can be carried out.

It would also be preferable to minimize, as much as possible, the cost of making that conversion. A principle cost, as exhibited by prior art methods of caliber conversion, lays in the need to replace the slide of the original Colt .45. It was thus deemed advisable to seek out whatever additional changes to the weapon would be necessary in order to allow that original slide to be retained. Among other purposes, the slide serves to extract and eject expended cartridges, so it was thought to devise means by which that process could be carried out in spite of the smaller size of the cartridges, but with the original slide still intact. That effort finally settled on the use of a sliding extractor, with the original slide remaining to carry out its other purposes such as locking the weapon "open" when all of the cartridges therein had been expended. The present disclosure shows and describes the means for so doing, while also adding a number of other new and novel features to the art of caliber conversion.

Semi-automatic handguns operate generally on the basis of one or the other of two different main principles. One of these is a "blowback" or "spent case projection" operation in which the breech block or bolt of the handgun is not physically locked to the barrel. Upon a cartridge being fired, the cartridge case is impelled backwards onto the face of the bolt or block, which is then driven to the rear at a much lower velocity than that of the bullet. When the bullet leaves the muzzle, the propelling gas is then free to leave also, and the gas pressure against the cartridge case and breech block drops instantly. However, enough momentum would have been imparted to the breech block to allow the re-loading action to continue in the absence of continued pressure.

A second main principle on which semi-automatic handguns operate is that termed "short recoil." In this method of operation, generally used only on more powerful handguns, the barrel and breech block are mechanically locked together at the moment of firing in order to contain the high pressures involved. As the bullet is propelled down the barrel, an equal and opposite force is applied to the breech block. Under the influence of this force, the barrel and breech block begin to accelerate in the direction opposite to that of the bullet, albeit at a much lower velocity because of the greater mass of the barrel and breech block than of the bullet. After a brief travel during which time the bullet has exited the barrel and the pressure has dissipated, the breech block is unlocked from the barrel and allowed to continue rearward while the movement of the barrel is halted. As the breech block continues rearward, the fired cartridge case is extracted and expelled, and the breech block can return to place a fresh cartridge in the chamber. This is the principle of operation of the M1911 .45 caliber pistol or "Colt .45" to which the present invention has been specifically applied.

A third main principle on which semi-automatic arms operate, although not usually applied to hand guns, is that of gas operation in which for greater force a portion of the propelling gas is tapped off from the barrel via a port and then directed into a cylinder containing a piston that moves rearward in response to that gas pressure. The piston is in turn coupled to the breech block, which is then forced to open and re-load the handgun. In some variations, no cylinder or piston will be used, and the gas is allowed to impinge directly on the bolt or similar mechanism. The U.S. Army's M1 carbine employs this gas operated principle, as does the present invention. Analogous uses of the present invention on other handguns of the same general type are of course intended to be encompassed within the claims appended hereto.

Starting with any of these principles, the development of any adaptation of the handgun that would permit the use of lower caliber ammunition requires taking account of the various steps involved in the standard self-loading or semi-automatic firing processes, noting that the design considerations applicable to the larger and the smaller caliber guns can be quite incompatible. Large caliber, self-loading handguns nearly always employ a locked breech mechanism to contain the high chamber pressures produced on firing. This structure, particularly with the Colt .45, forms a short recoil system wherein the barrel and breech block are locked together during an initial recoil period that follows the firing of a cartridge, and after the resultant breech pressure has subsided the barrel and breech block are uncoupled to allow the breech block to recoil away from the barrel, eject the expended cartridge, and load a fresh cartridge. Such systems necessarily employ strong and massive recoiling parts in order to contain the high pressures generated and to slow the acceleration of the moving parts so that they do not move to the "unlock" position until enough time has passed for the chamber pressure to subside. With the larger caliber ammunition, sufficient force to operate the full "reload" mechanism is readily available from firing the cartridge because of the powerful pressures generated.

Conversion to the use of lower caliber ammunition thus means that the levels of pressure characteristic of the higher caliber ammunition are no longer available. Because of the lighter weight of the smaller caliber handguns, it is indeed the practice in the designs of the lower caliber handguns that have less weighty parts to have such weapons operate on the less powerful blowback principle. In converting the larger handgun to use lower caliber ammunition, some means must then be employed to obtain the forces necessary for movement of the heavy parts of the original handgun. Advantageously, the adaptation of such a handgun to use smaller caliber ammunition would be carried out so that the weapon would use the gas pressure principle in a way that will function properly when necessarily using the lower pressure that is available from that lower caliber ammunition.

The breech face, that during the chambering portion of the firing cycle is used to rake the next cartridge out of the magazine and into the chamber, is large in order to support the base of the large .45 cartridge during firing. The breech face also contains a firing pin located along the central axis of the barrel so as to detonate the center-fire cartridge, and an extractor claw is located radially away from the barrel axis to extract fired or unfired cartridge cases from the chamber. The exact radial position of the extractor is dictated in part by the diameter of the cartridge. Generally, there is also a fixed ejector mounted to the main frame in a position as to impact the edge of the base of the recoiling cartridge case being carried rearward by the extractor mounted on the breech face, and at a point approximately diametrically opposite to the extractor. The impact of the moving cartridge case on the ejector serves to generate a moment to the cartridge case about a transverse axis of the extractor claw, which moment then causes the empty cartridge case to pivot sideways and be expelled from the gun. Of course, the radial position of the ejector relative to the barrel axis is also dictated by the diameter of the cartridge. The return cycle of the breech block is normally powered by a spring that has been compressed during the recoil portion of the cycle. This spring is relatively heavy in order to store enough energy to return the heavy recoiling parts and to strip the next cartridge from the magazine.

With reference to conversions such the present one in which a change is made not only in caliber but also to accommodate the rim fire cartridge of the .22 instead of the center fire cartridge in the .45, although not used in the principal prior art reference herein noted below, it is also known to use an eccentric chamber/bore in the adapted firearm so that a center-firing mechanism will align the firing pin of the handgun with the rim of the .22 rim fire cartridge, this technique being seen most often in single shot adaptors and firearms, e.g., in the Stevens Crackshot single shot rifle. Another adaptation feature known in the art is the use in the adapted firearm of a magazine that is inwardly tapered back-to-front (towards the muzzle) so as to allow more nearly parallel stacking of the rimmed .22 cartridge, as found, for example, in the .22 caliber Smith and Wesson 422.

More specific background from the prior art will now be set out with reference to the M1911 Colt .45 in particular, as shown in FIG. 1, which is a perspective, exploded view of those portions of a Colt .45, designated herein as Colt .45 pistol 10, that pertain to the conversion comprising the invention. The operation of this .45 caliber handgun and a method of conversion thereof to .22 caliber is described in U.S. Pat. No.2,090,657 issued Aug. 24, 1937, to Williams, which patent by this reference is hereby incorporated herein as though fully set forth. That is, FIG. 1 shows those portions of the Colt .45 pistol as described in the Williams '657 patent as pertain specifically to the present invention, but not necessarily to the Williams '657 conversion. Versions of the "Colt .45" are also shown in the original patents therefor, which are U.S. Pat. No. 580,924 issued Apr. 20, 1897, to J. M. Browning; U.S. Pat. No. 984,519 issued Feb. 14, 1911, to J. M. Browning; and U.S. Pat. No.1,070,582, issued Aug. 19, 1913, to J. M. Browning.

Colt .45 pistol 10 comprises a frame 12, barrel 14, locking lugs 16, slide 18, slide stop 20, barrel bushing 22, recoil spring 24, spring guide 26, spring retainer 28, magazine 30 and chamber 32. FIG. 1 also shows takedown notch 34 and slide stop tang 36, that are shown again in FIG. 2 in more visible form. It can be seen that recoil spring 24 is first disposed over spring guide 26, and is contained or retained within spring retainer 28. FIG. 1 also shows breech face 38, slide grooves 40, slide stop hole 42, frame alignment hole 44, barrel bushing tang 46, magazine well 48, feed ramp 50, feed lips 52, depending rib 54, slide stop notch 56, slide hood 58, follower 60, slide stop shaft 62, pivot link 64 and firing pin 66. It may be noticed that "feed lips 52" has two lead lines in FIG. 1, which is because there are left and right feed lips 52. A listing of relevant parts in the original Browning Colt .45 pistol 10, the parts of the Williams '657 conversion kit 70, and all of the parts of the invention is given in Table I below.

In what follows, any part shown in the later figures that has a reference number less than 70 will be a part of the original Colt .45 pistol 10 that either the Williams '657 conversion kit 70 or the present conversion kit leaves in place, while FIG. 1 shows all of the relevant parts of the original Colt .45 pistol 10. The parts of the present conversion kit begin with the number 100. For purposes of easy access and better orientation to what will follow, however, the Williams '657 parts are listed here: conversion kit 70, firing pin 72, extractor 74, ejector 76, slide 78, barrel 80, floating chamber 82, magazine 84, depending rib 86, breech face 88, feed ramp 90, feed lips 92, chamber 94, and magazine depressions 96. (A part of the present invention that roughly corresponds to the Williams '657 floating chamber 82 is here termed "gas piston 108.") Breech face 88 is formed in the Williams '657 conversion by carrying out a counter bore into slide 78, thus to provide a recess to enclose the base of the cartridge and maintain the cartridge rim in close contact with extractor 74 during the extraction. Chamber 94 is that portion of floating chamber 82 that holds the cartridge during the firing portion of the operation cycle, and as shown in FIGS. 3, 4, chamber 94 is a hole coaxially located within floating chamber 82 and sized so as to receive the cartridge closely. The roles of the other parts just listed will be set out below. Magazine depressions 96 in the side walls of the magazine serve to produce a narrow section therein to center the smaller .22 caliber cartridges. This permits the portions of the magazine on either side of these depressions to be kept at the same size as is the standard .45 caliber magazine and hence fit closely into magazine well 48.

The firing of a cartridge in Colt .45 pistol 10 causes both barrel 14 and slide 18 to be propelled rearward, and at a certain point locking lugs 16 of barrel 14 are disengaged from slide grooves 40 of slide 18 by pivot link 64 on barrel 14, whereby barrel 14 does not itself continue further, while slide 18 proceeds further rearward. Pivot link 64 is rotatably attached to the underside of barrel 14, and at the distal end thereof connects rotatably to slide stop shaft 62 of slide stop 20. As slide 18 recoils, pivot link 64 pivots around slide stop shaft 62 of slide stop 20 and pulls the rear of barrel 14 downward and out of engagement with slide 18 as barrel 14 goes through its shorter distance of movement. The rearward movement of slide 18 compresses recoil spring 24 as contained between spring guide 26 and spring retainer 28, the spent cartridge is ejected, and a new cartridge is drawn from magazine 30 in the well known manner, and that new cartridge is placed into chamber 32 as both barrel 14 and slide 18 are returned to their original positions through the expansion of recoil spring 24. (The term "slide stop" should not be taken to mean a "stop" of that rearward motion of slide 18, since that is accomplished by the compression of recoil spring 24 and ultimately by contact of slide hood 58 with the base of spring guide 26. Slide stop 20 serves instead to lock slide 18 in an "open" position upon ejection of a last cartridge, or that same process can be carried out by pressing upward on slide stop 20 at a time at which slide 18 is in the most rearward (open) position and slide stop tang 36 can engage slide stop notch 56.)

A showing of the Williams '657 conversion is accomplished in part by FIG. 3, which shows in horizontal section, as a cutaway view from the top, a Colt .45 pistol 10 that has been converted to .22 caliber cartridges by the Williams conversion kit 70. FIG. 3 shows the Williams '657 firing pin 72, extractor 74, ejector 76, slide 78, barrel 80, a vibrating member, sometimes called a floating chamber and termed herein as floating chamber 82, breech face 88, and chamber 94. Extractor 74 is a hook-like device that removes the empty cartridge case from floating chamber 82, and the manner of so doing in the invention will be explained below. Ejector 76 is a "drop-in" part that does not move but is connected into frame 12 under barrel 80 and floating chamber 82, sitting just above magazine 84 on the left side of the firearm, to the left of depending rib 86 of the Williams '657 conversion slide 78. Ejector 76 acts as a "shoulder" against which a spent case that is being withdrawn from floating chamber 82 by extractor 74 will strike, thus causing that spent case to be ejected sideways from the weapon, and the corresponding process in the invention will also be explained below.

The labeled parts shown in FIGS. 4–5 extend beyond those in FIGS. 1–3, and show more detail as to the firing and extractor portions of the Williams '657 patent, specifically including the Williams '657 magazine 84 and depending rib 86. The role of each of the parts of FIGS. 1–5 will be explained below in the Detailed Description of the Invention, for purposes of comparison with FIG. 6 that shows the various parts of conversion kit 100 that constitutes the present invention.

SUMMARY OF THE INVENTION

Conversion hardware and a methodology are provided that will replace selected components of larger caliber handguns such as center fire .45 or 9 mm pistols, thus to yield a handgun that for practice firing will fire the smaller, rim fire .22 caliber ammunition and be much less expensive to use. To achieve optimum training effectiveness the converted handgun is made to exhibit as nearly as possible the weight, balance and function of the larger caliber gun. There are four main aspects of the invention, which are found in (1) a different barrel; (2) a different extractor; (3) an eccentric gas piston; and (4) a different magazine assembly.

A number of features deriving from those components and their functions, which are also inventive in their own right, are thus provided, including the introduction of a toroidal groove 160 at the front end of gas piston 108 so as to minimize the accumulation of fouling; an intentional misalignment of the barrel bore axis relative to the barrel outside diameter so as to coordinate the line of fire with the existing sights; asymmetrical feed lip 142 on the magazine so as to allow a blunt breech face 38 and depending rib 54 to extract the smaller .22 cartridge; addition of control lip 146 to the magazine to guide the expended cartridge during extraction; and the placement of a new feed ramp 138 within the magazine in place of the existing feed ramp. As will be explained later, the existing feed ramp 50 is not suitably disposed to function with the smaller .22 cartridge, and neither could a feed ramp such as the Williams '657 feed ramp 138 be used because of interference with the unmodified breech face of the original slide 18. In order to draw an expended cartridge from the chamber, therefore, a sliding extractor operated by the movement of the slide, or by the part that moves the slide but is yet separate from the slide which is unchanged, was adopted. Only the barrel and magazine and not the slide/breech block are replaced in this conversion, so the present conversion is much more easily effected than those described in the prior art.

BRIEF DESCRIPTION OF THE SEVERAL VIEWS OF THE DRAWINGS

A preferred embodiment of the invention will now be described as an example, which is not to be interpreted in any limiting sense since the full spirit and scope of the invention is only to be determined by the claims appended hereto, the example being described with reference to the accompanying drawings, in which:

FIG. 16 is a partially cutaway left side elevation view of the magazine assembly in a preferred embodiment of the invention.

FIG. 17 is a rearward end elevation view of the magazine assembly of FIG. 16.

FIG. 18 is a right side elevation view of the magazine assembly of FIGS. 16, 17.

FIG. 19 is an oblique view of the top of the magazine assembly of FIGS. 16–18.

DETAILED DESCRIPTION OF THE INVENTION

Figure 2:
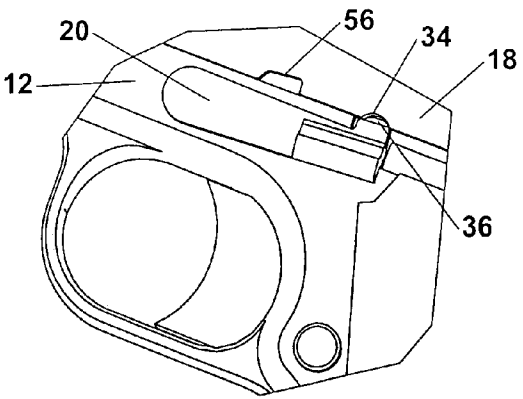
Fig. 2 Prior Art
FIG. 2, also from the prior art, is a left-side perspective view of a portion of the Colt .45 semi-automatic pistol of FIG. 1 that better shows the locations of the takedown notch on the slide and the tang on the slide stop of the pistol of FIG. 1.
Figure 3:
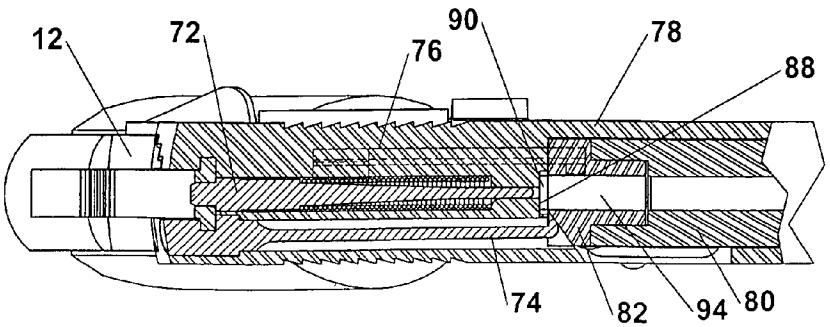
Fig. 3 Prior Art
FIG. 3, also from the prior art, shows a top plan, cutaway view of the pistol of FIG. 1, but now including the entirety of those parts of the pistol that are made visible by that cutaway view, together with modifications that are made thereto, by the conversion set out in the Williams '657 patent.

In the following description, the term "eccentric" with reference to an axis means that the axis is displaced from the central axis of the barrel, although that axis may lie parallel to that central axis. The term "divergent" or "diverges" means that the axis, whether or not also eccentric, lies at an angle to the central axis of the weapon barrel, and may or may not have a common point with that central axis. An axis can be eccentric, divergent, both, or neither (thus to be coaxial and hence coincide exactly), but the bore axis in the invention will have the actual disposition described below and shown in the drawings.

Figure 1:
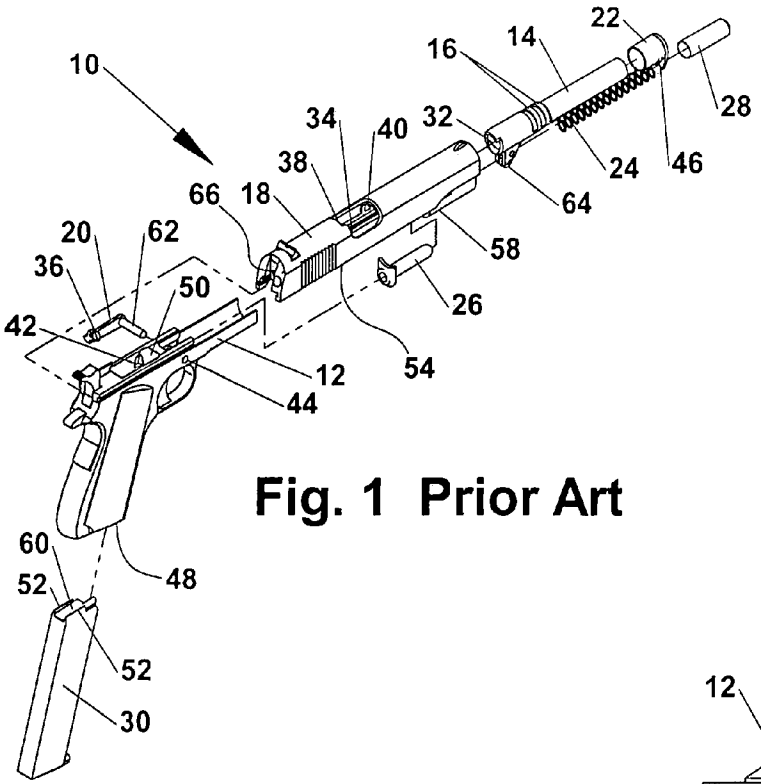
Fig. 1 Prior Art
FIG. 1 from the prior art is an exploded view of a Colt .45 semi-automatic pistol that relates specifically to the adaptation in caliber size that comprises the present invention.
Figure 6:
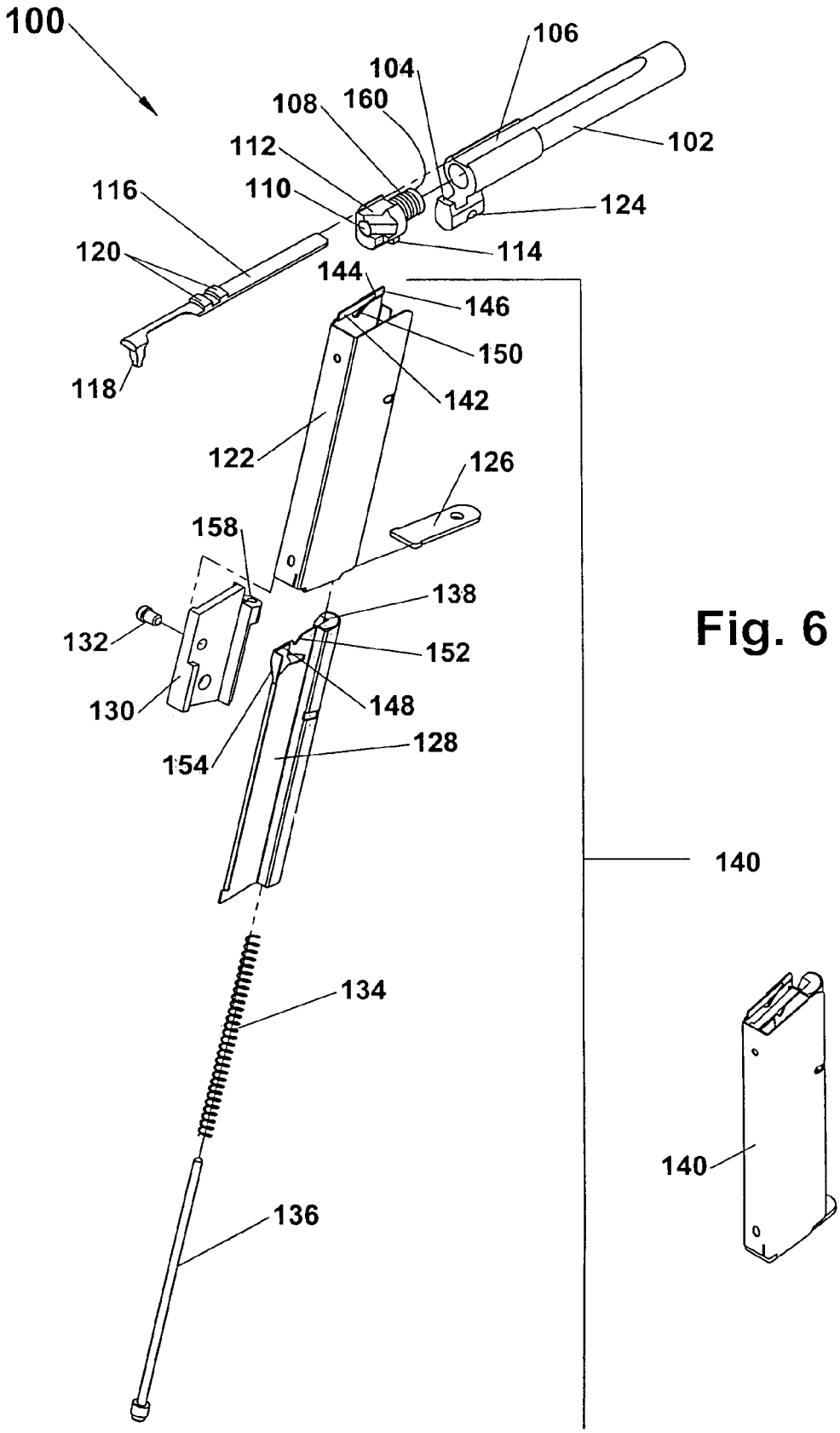
FIG. 6 shows in both exploded and assembled form the relevant components of the Colt .45 to .22 caliber conversion kit in the preferred embodiment of the invention.

FIG. 6 shows the components comprising the invention, specifically those parts that are employed relative to the original Colt .45 as shown in FIG. 1 of the Williams '657 patent. The Colt .45 can also to be seen in the first "Browning automatic" patents, i.e., U.S. Pat. No. 580,924 issued Apr. 20, 1897, to J. M. Browning; U.S. Pat. No. 984,519 issued Feb. 14, 1911, to J. M. Browning; and U.S. Pat. No. 1,070,582, issued Aug. 19, 1913, to J. M. Browning. The conceptual basis of the invention and of the several aspects thereof will be set out below, then followed by a description of how each such aspect is brought about.

More specifically, FIG. 6 shows conversion kit 100, the use of which will now be set out with respect to various ones of both parts 12–62 of the original .45 caliber pistol 10 and parts 102–160 of conversion kit 100, wherein problems involving safety and the like are also taken into account, and for which the steps that bring about the conversion are as follows, starting with the steps required as to the original Colt .45 weapon:

1. Depress the magazine release button (not shown) and release magazine 30 from magazine well 48.
2. Retract slide 18 and inspect barrel 14 to ensure there is no cartridge in chamber 32.
3. Depress spring retainer 28 far enough to allow barrel bushing 22 to be rotated; rotate barrel bushing 22 by 90° (90 degrees) clockwise as viewed from the muzzle end.
4. Remove recoil spring 24 and spring retainer 28.
5. Retract slide 18 far enough to align takedown notch 34 in slide 18 with slide stop tang 36 at the top of slide stop 20. (Takedown notch 34 and slide stop tang 36 are shown in both of FIGS. 1 and 2.)
6. Withdraw slide stop 20 from frame 12.
7. Withdraw barrel 14, slide 18, barrel bushing 22, and spring guide 26 from frame 12.
8. Remove spring guide 26 from slide 18.

9. Rotate barrel bushing 22 by 135° (135 degrees) counter-clockwise as viewed from the muzzle end and withdraw barrel bushing 22 from the front (muzzle) end of slide 18.
10. Withdraw barrel 14 from slide 18.

The remaining frame 12 and components are now in condition for the installation of the conversion kit 100 components of FIG. 6.

The components that make up conversion kit 100 and bring about the conversion according to the present invention so as to allow a .45 caliber pistol to accommodate .22 caliber ammunition are shown in FIG. 6 and listed in Table I below, which also shows the relevant parts of the original .45 caliber pistol and the parts of the conversion kit of the Williams '657 patent of FIGS. 1–5 that were set out earlier: The parts of conversion kit 100 are shown in much greater detail than are those of the original Colt .45 or the Williams '657 patent so as to present only enough of the latter two sets of drawings as would be necessary to bring out the differences found in the present conversion kit, while the parts of conversion kit 100 are shown in such greater detail so as to permit a thorough explanation of the invention. (For example, "magazine 84" in the Williams list actually includes the magazine body, floor plate, spring, thumb button and follower, and "slide 78" consists of the slide, firing pin, firing pin spring, extractor, firing pin retainer, front sight, and rear sight.)

TABLE I

| Original Colt .45 | Williams '657 Conversion | Present Conversion |
|---|---|---|
| 10 Colt .45 Pistol | 70 Conversion kit | 100 Conversion kit |
| 12 Frame | 72 Firing Pin | 102 Barrel |
| 14 Barrel | 74 Extractor | 104 Barrel tang |
| 16 Locking lugs | 76 Ejector | 106 Barrel groove |
| 18 Slide | 78 Slide | 108 Gas piston |
| 20 Slide stop | 80 Barrel | 110 Chamber |
| 22 Barrel bushing | 82 Floating chamber | 112 Piston groove |
| 24 Recoil spring | 84 Magazine | 114 Chamber lug |
| 26 Spring guide | 86 Depending rib | 116 Extractor |
| 28 Spring retainer | 88 Breech face | 118 Extractor claw |
| 30 Magazine | 90 Feed ramp | 120 Extractor lugs |
| 32 Chamber | 92 Feed lip | 122 Magazine body |
| 34 Takedown notch | 94 Chamber | 124 Barrel alignment hole |
| 36 Slide stop tang | 96 Magazine depressions | 126 Floor plate |
| 38 Breech face | | 128 Magazine filler |
| 40 Slide grooves | | 130 Follower |
| 42 Slide stop hole | | 132 Thumb button |
| 44 Frame alignment hole | | 134 Magazine spring |
| 46 Barrel bushing tang | | 136 Spring guide |
| 48 Magazine well | | 138 Feed ramp |
| 50 Feed ramp | | 140 Magazine assembly |
| 52 Feed lips | | 142 Asymmetric feed lip |
| 54 Depending rib | | 144 Ejector shoulder |
| 56 Slide stop notch | | 146 Control lip |
| 58 Slide hood | | 148 Magazine filler top lip |
| 60 Follower | | 150 Cartridge rim body ramp |
| 62 Slide stop shaft | | 152 Cartridge rim filler ramp |
| 64 Pivot link | | 154 Alignment ramp |
| 66 Firing pin | | 156 Floor plate retaining lips |
| | | 158 Slide stop actuator |
| | | 160 Toroidal groove |

Conversion kit 100 is preferably applied to a Colt .45 pistol in accordance with the following steps:

1. Hold slide 18 upside down and drop extractor 116 into slide 18 in an orientation such that extractor claw 118 is toward breech face 38. Engage extractor lugs 120 within the corresponding slide grooves 40 in slide 18.
2. Install gas piston 108 with included chamber 110 into barrel 102, with chamber lug 114 on gas piston 108 being engaged behind the corresponding barrel tang 104 in barrel 102.
3. Install barrel 102 and the gas piston 108 and included chamber 110 into slide 18. Extractor 116 must slide into piston groove 112 and barrel groove 106 in the top of the barrel 102, and the gas piston 108/barrel 102 assembly as just put together must be inserted to the point that the rear face of gas piston 108 contacts breech face 38 of slide 18.
4. Install spring guide 26 into slide 18.
5. Install the assembly made up of slide 18, barrel 102, gas piston 108 (with included chamber 110), extractor 116 and spring guide 26 onto frame 12.
6. Retract slide 18 until takedown notch 34 in slide 18 aligns with slide stop hole 42 in frame 12. Align barrel alignment hole 124 with frame alignment hole 44.
7. Install slide stop 20 onto frame 12 and barrel 102. Return slide 18 to the forward position (in the muzzle direction).
8. Install barrel bushing 22 onto slide 18 and rotate clockwise (as seen from the muzzle end) as far as possible.
9. Install recoil spring 24 into the open end of slide 18 below barrel 102 and insert until recoil spring 24 slides over the end of spring guide 26.
10. Install the hollow end of spring retainer 28 over the exposed end of recoil spring 24.
11. Compress recoil spring 24 and spring retainer 28 into the end of slide 18 until spring retainer 28 falls completely inside the end of slide 18.
12. Rotate barrel bushing 22 counter-clockwise as seen from the muzzle end until barrel bushing tang 46 aligns with spring retainer 28.
13. Release spring retainer 28 into the corresponding notch in barrel bushing tang 46.
14. Install magazine assembly 140 into magazine well 48 of frame 12.

In principle, it would not be necessary to replace the original recoil spring 24 with a new spring, hence no such spring is shown in the "Present Conversion" column of Table I. However, because of non-uniformity of manufacture, some original .45 caliber weapons will have an unusually strong spring that could be too strong relative to the forces generated by the invention using a .22 cartridge. For that reason, a more uniform yet still standard spring is supplied with conversion kit 100 that a user can use to replace the spring of that user's original .45 in case such original spring was in fact too strong.

The foregoing descriptions, including those of both the disassembly of the original Colt .45 and the re-assembly of the firearm having been adapted by conversion kit 100 to accommodate .22 caliber ammunition, set out a complete instance of the present conversion process, so the rationale for and effects of those changes can now be explained. The invention lies in the nature of the parts removed and of the replacement parts as set out in those process steps. A thorough understanding of this conversion process should in itself demonstrate the relative simplicity of the methodology and parts of the invention, and hence the ease of application and lesser cost as compared to the prior art. The invention also gives the converted firearm certain features that are absent from those found in weapons deriving from any prior art conversion methods of which the inventor is aware.

There are a number of features in the conversion kit comprising the invention, which are: (1) a modified (intentionally divergent) bore; (2) a modified (sliding) extractor that avoids the need to replace the slide; (3) a modified (tapered) magazine assembly also having (a) asymmetrical feed lips by way of a shoulder to direct the cartridge and (b) a specifically adapted feed ramp; (4) an eccentric gas piston; and (5) a toroidal groove at the front end of the floating chamber (herein referred to as a gas piston). Each change will interact with at least one of the others, and hence these changes must be described more or less together.

Figures 4, 5:
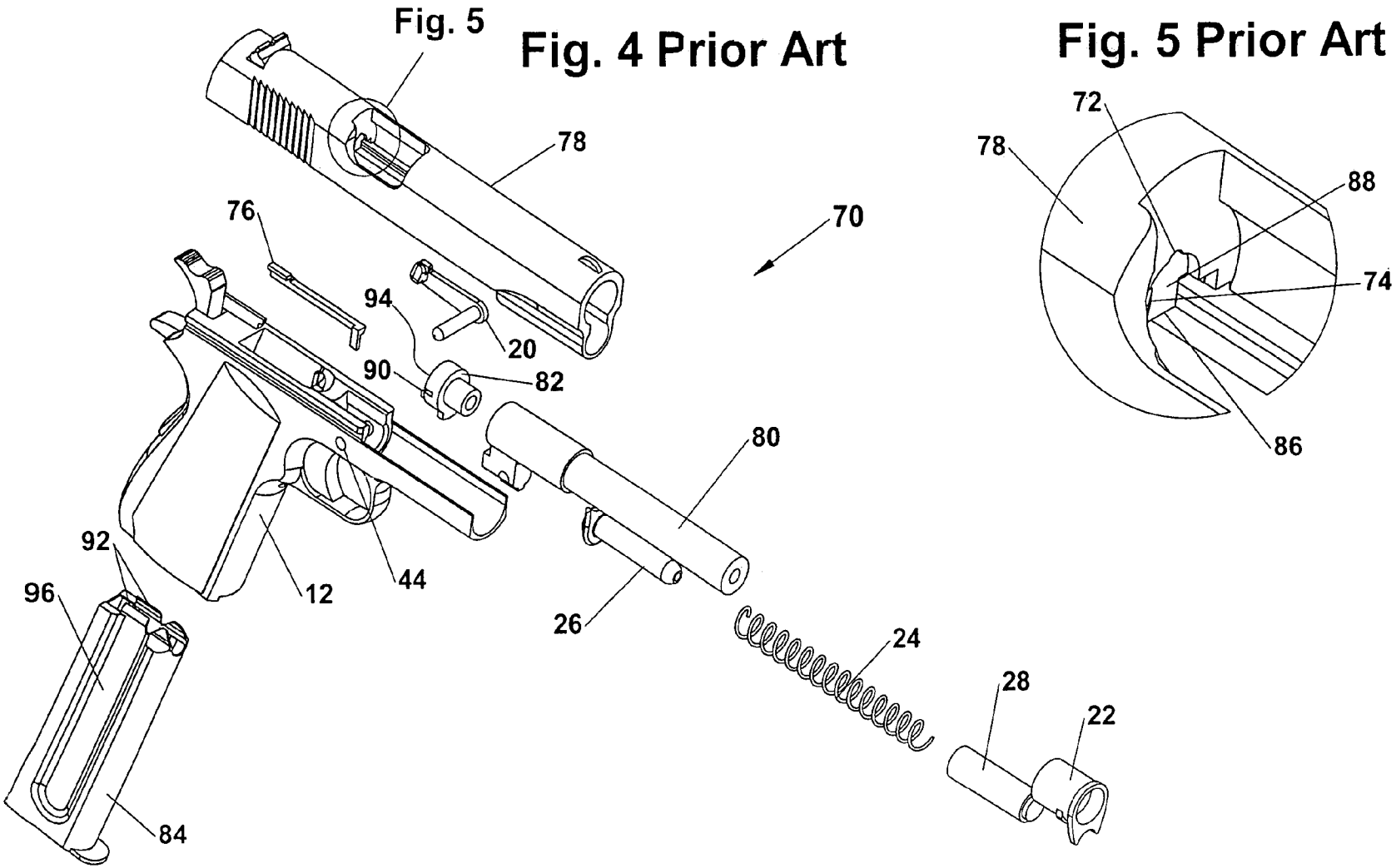
Fig. 4 Prior Art
Fig. 5 Prior Art
FIG. 4 shows in exploded form the components of a Colt .45 to .22 caliber conversion kit as carried out by further aspects of the procedure of the Williams '657 patent.
FIG. 5 shows in larger scale the extractor portion of the Williams '657 conversion kit of FIG. 4 that better shows those cartridge extraction elements.
Figure 7:
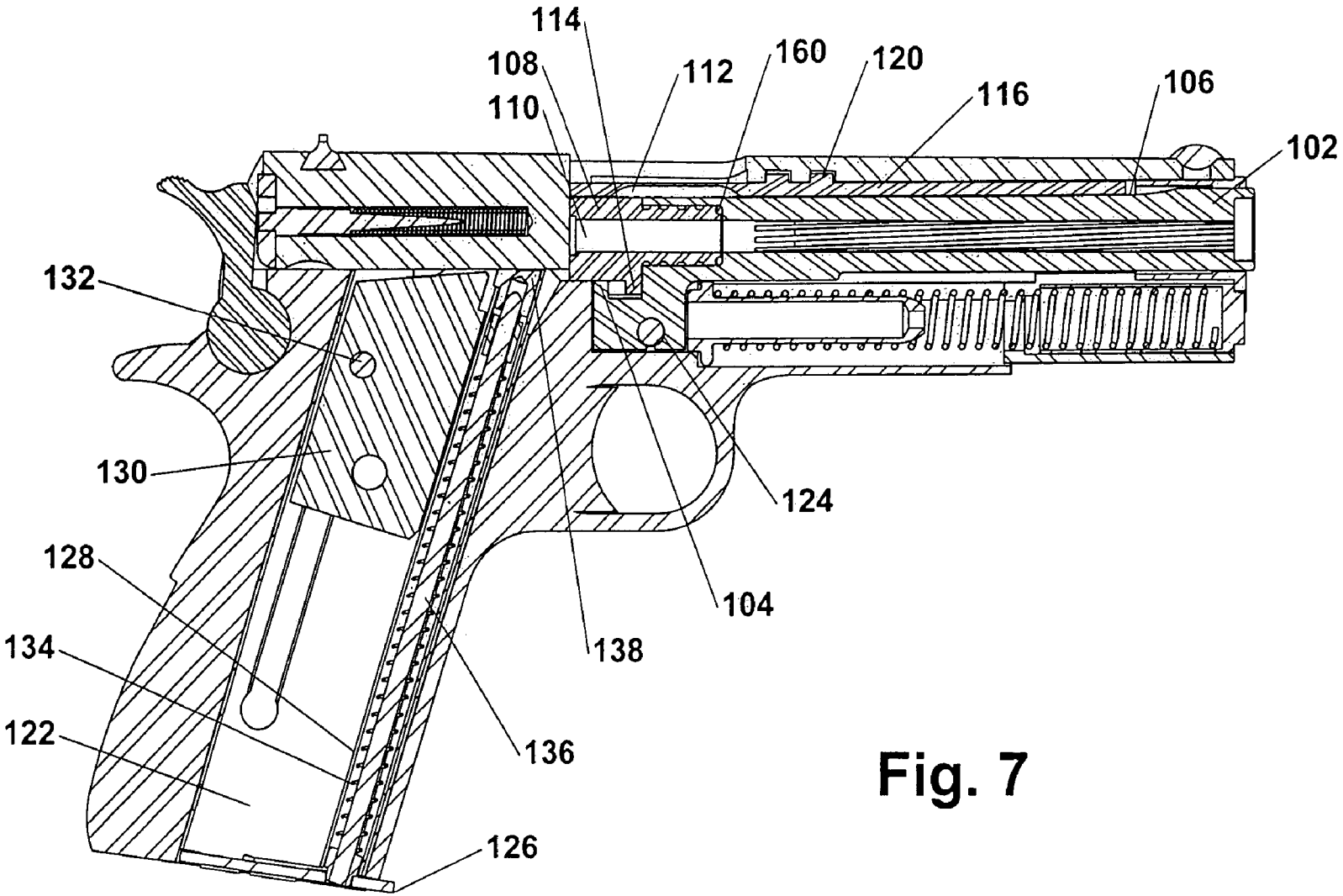
FIG. 7 is a cutaway side elevation view of a .45 caliber pistol converted to .22 caliber in accordance with the invention, made especially to bring out the actual locations of the several parts that could not be shown in the exploded view of FIG. 6.
Figure 8:
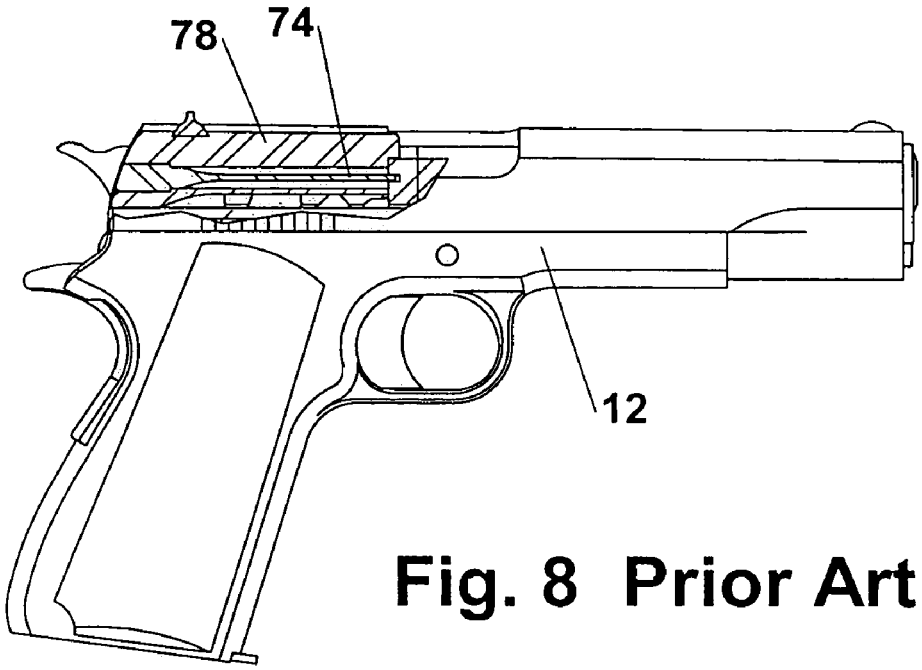
Fig. 8 Prior Art
FIG. 8 is a side elevation view of a .45 caliber pistol having been converted to .22 caliber by the procedure of the Williams '657 conversion kit, and identifying those parts only that are relevant to the conversion.
Figure 9:
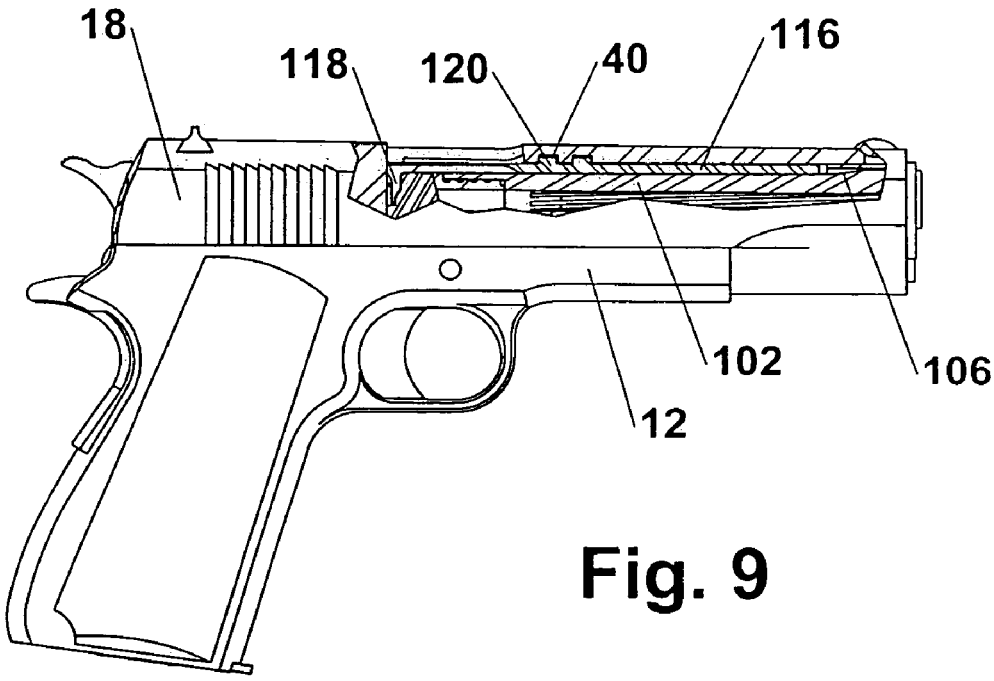
FIG. 9 is a partially cutaway side elevation view of a .45 caliber pistol having been converted to .22 caliber by the procedure of the present invention, again identifying only those parts that are involved in the conversion.

There will first be identified some of the differences between the conversion as carried out by the invention and that carried out according to the Williams '657 patent, which patent is taken herein to describe that conversion process, of those of which this inventor is aware, that comes the closest to having any features in common with the present invention. For an initial broad outline, the parts involved in the Williams '657 conversion are shown in FIGS. 4, 5, and those of the present conversion, following the steps outlined above, are shown in FIGS. 6 and 7. In FIGS. 8, 9, there are respectively shown the firearms that result from the Williams '657 conversion and from the present conversion.

A comparison of these drawings shows firstly that the weapon as converted by the present invention shown in FIG. 6 does not include a new slide, but retains the original slide 18 and slide grooves 40, while the Williams conversion in FIGS. 4, 5 has a slide 78 that is different from the original slide 18. Both conversions employ extractor mechanisms that are different from those of the original Colt .45, but that are also different from each other, as shown by a comparison of extractor 74 of Williams '657 in FIGS. 5, 8 with extractor 116, extractor claw 118, and extractor lugs 120 of the invention as shown in FIG. 9. Also shown are barrel 102 of the present invention in FIGS. 6, 7 and the Williams '657 barrel 80 in FIGS. 3, 4, that again both differ from the original barrel 14 and from each other. It is the change in both the location and orientation of the bore within barrel 102 in the invention that preserves the sighting of the original .45 (not addressed by Williams), and different extraction means (also substantially involving the magazine) that avoids any need to change the slide (as Williams in fact does change), that provide the principal advantages of the invention, while other features of the invention, that in part are required by the changes just noted, also have advantages of their own.

Figure 10:
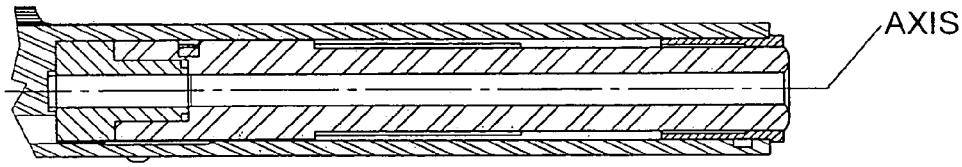
Fig. 10 Prior Art
FIG. 10 shows in a top plan view the single axis of the bore and barrel in a Colt .45 pistol as converted to .22 caliber by the Williams procedure.
Figure 11:
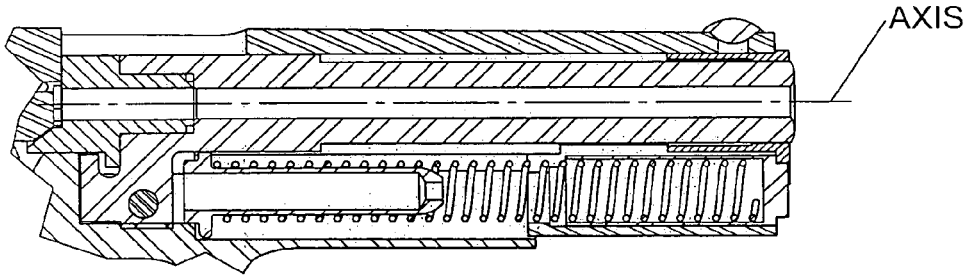
Fig. 11 Prior Art
FIG. 11 shows in a side elevation view the single axis of the bore and barrel in a Colt .45 pistol as converted to .22 caliber by the Williams procedure.
Figure 12:
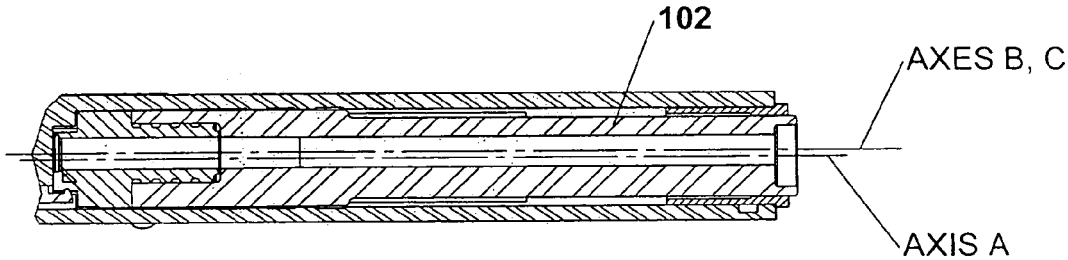
FIG. 12 shows in top plan view the axes A and B that are used to explain the nature of the barrel in the preferred embodiment of the invention, and then axis C that is actually used, for which the parts thereof are those of FIG. 6.
Figure 13:
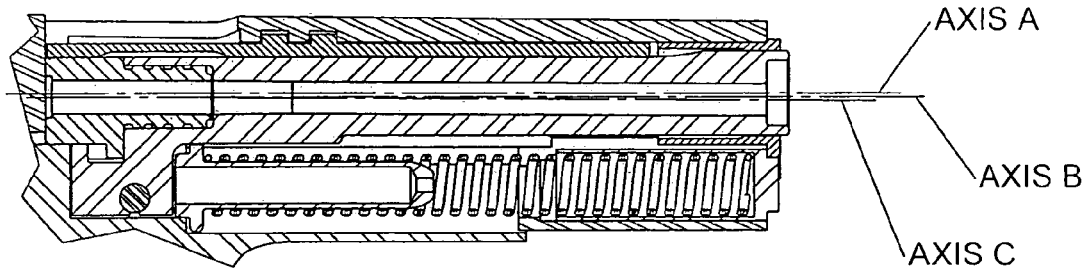
FIG. 13 shows in a side elevation view the axes shown in FIG. 12.
Figure 15:
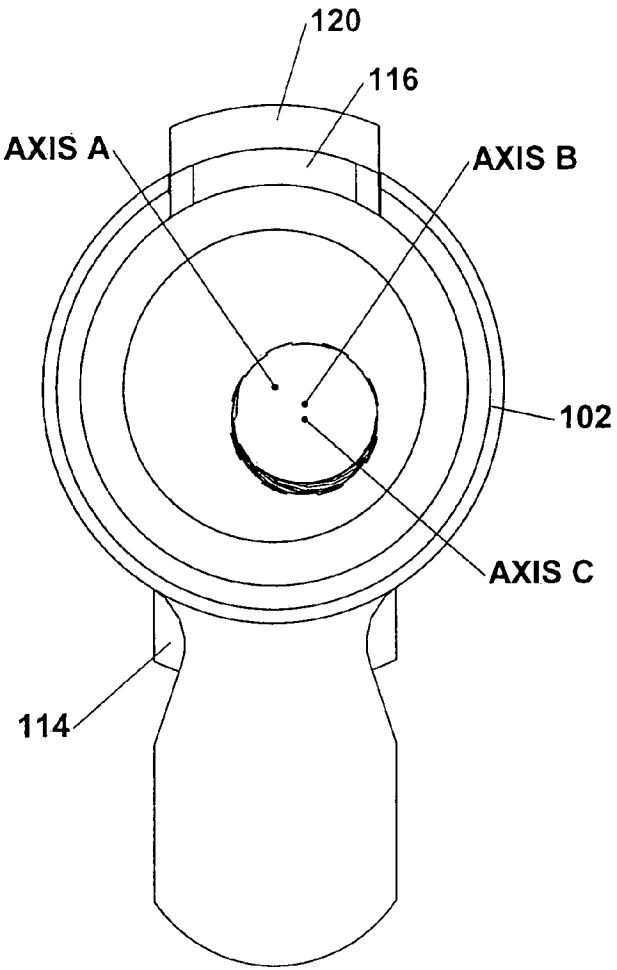
FIG. 15 is a distal (muzzle) end elevation view of the conversion-substituted barrel in accordance with the invention showing the locations of the axes of FIGS. 12 and 13, again including identification of the relevant parts.

To address the barrel first, FIG. 10 shows a top plan view of the single axis (labeled "AXIS") of the bore and barrel in a Colt .45 pistol as converted by the Williams procedure, and FIG. 11 shows that same axis in a side elevation view. By contrast, FIG. 12 shows in top plan view the several axes A, B, and C that will help to describe the preferred embodiment of the invention, for which the parts are those of FIG. 6, and FIG. 13 shows those same axes in a side elevation view. Axis A is the central axis of the outer diameter (OD) of barrel 14 of the original Colt .45, and also for barrel 102 of the present conversion kit. Axis B lies parallel to axis A but is displaced radially therefrom, and represents the central axis of a bore that extends about 15 mm (0.6 in.) deep into the breech end of barrel 102, for use with a gas piston that will be discussed below. That displacement serves to align the rim of a .22 cartridge with firing pin 66 of the original Colt .45, the amount of that displacement needing to correspond with the radius of the .22 cartridge. Axis C is the axis of the bore through which the cartridges of the weapon converted by the present invention will be fired, and is formed within barrel 102 as a part of the conversion kit. The ends of those three axes are shown in FIGS. 14 and 15, in views that look respectively from the breech and the muzzle ends of barrel 102.

Figure 14:
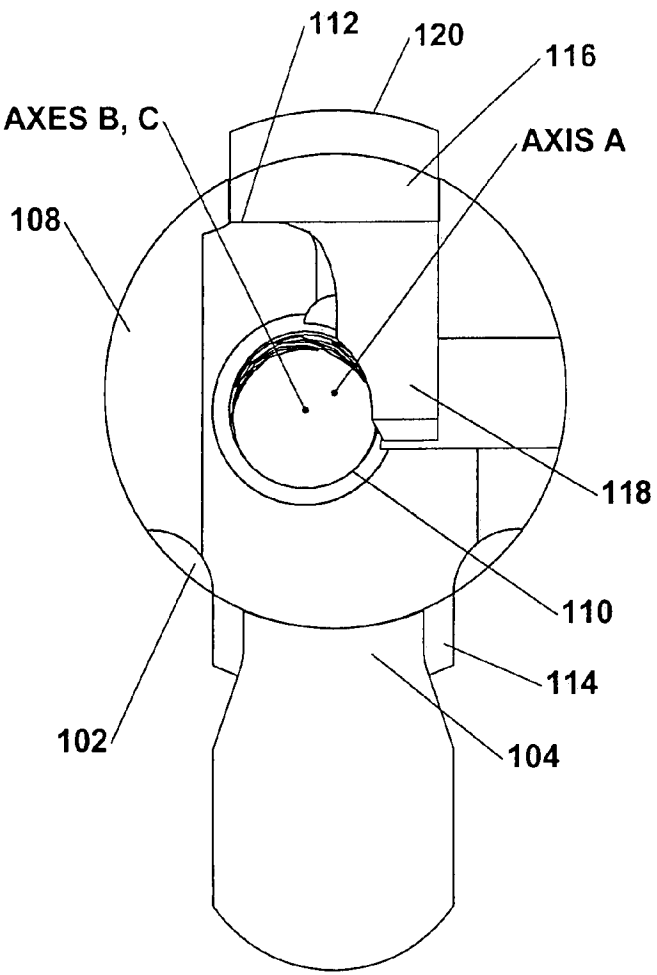
FIG. 14 is a proximal (breech) end elevation view of the conversion-substituted barrel in accordance with the invention, showing the locations of the axes of FIGS. 12 and 13, also including identification of the relevant parts.
Figure 24:
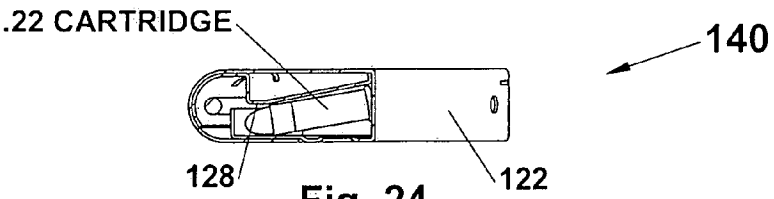
FIG. 24 is a horizontal cross section of the magazine assembly of FIGS. 16–23, taken lower down in along the 24—24 line of FIG. 20, the showing the divergent alignment of the lower cartridges therein as also shown in FIG. 21.
Figure 23:
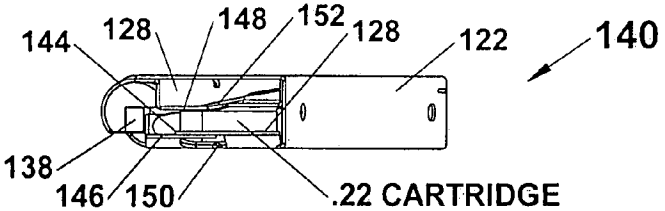
FIG. 23 is a horizontal cross section of the magazine assembly of FIGS. 16–22, taken along the 23—23 line of FIG. 20 and showing the top cartridge loaded therein with a fully straight alignment as shown in the top two cartridges in FIG. 21.

Axis C, as the axis around which the bore of the modified barrel 102 will in fact be centered, must then have the same location at the breech end as does the B axis, for the purpose of aligning the rim of the .22 cartridge with the Colt .45 firing pin 66 as just stated, and that disposition is shown in FIG. 14. However, axis C also diverges downwardly from axis B in passing towards the muzzle end of barrel 102, as shown in FIG. 15. By also having the B axis in FIG. 15, the displacement therefrom of the end of Axis C at the muzzle end of barrel 102 is readily seen. That disposition of axis C (i.e, of the bore) in barrel 102 is adopted in order to take account of the difference in energy of the .22 and .45 cartridges.

That is, the structure and weight distribution in the Colt .45 are such that the original axis bore lies above the center of mass of the weapon. When a cartridge is fired, a moment of rotation is developed that is often referred to as being around an axis passing through that center of mass, but more exactly that axis of rotation passes through whatever may be the actual point around which the weapon rotates, which is normally the user's wrist. Upon firing the weapon, the muzzle thereof will tend to rise-an action often called "buck." (That "buck" is different from the "kick,' i.e., the reverse direction, horizontal movement of the weapon that is most felt in firing high caliber rifles, and also shot guns.) Adjustment to compensate for that rise would have been made at the time of manufacture, in the sighting of the weapon relative to the direction in which axis A points. That is, in order to "cancel out" that rise, the sighting is fixed by the manufacturer with the intent that the point of impact of a bullet will be lowered just enough to hit the point at which aimed rather than above that point as caused by the buck.

The magnitude of the moment M of that rotation or buck is given by the product of the distance d between the bore axis and the center of rotation, and the force f generated by firing the cartridge, as that force is exercised over the time that the bullet remains within the bore. At first glance, the differences in the energy generated by the firing of a .22 caliber cartridge or a .45 cartridge, and between the mass of the .45 and .22 bullets, would both seem to affect the magnitude of the buck and hence the amount of displacement of the bore that would be required in the .22-converted .45 weapon. However, that turns out not to be the case, and it is only the energy difference that must be taken into account.

As to the effect on the bullet of firing the cartridge, the lighter .22 caliber bullet would be expected to accelerate faster than would the .45 cartridge and hence achieve a greater muzzle velocity, even with the lesser force applied. The time that the bullet is still within the bore would be also shorter. It is not how those factors come out that determines the amount of buck, however, but rather the effect that the explosive force has on the weapon itself. (By the "equal and opposite force" law, the energy generated by firing the powder will create a force to cause an acceleration in the bullet, but also an equal amount of force on the cartridge case and the firearm holding the cartridge case. The force will be the same in both cases, so the exact effect on the bullet is immaterial, the only thing of interest being the effect on the cartridge case and firearm.)

As to the firearm, the different forces generated by the .45 and .22 caliber cartridges will operate against essentially the same weapon, since insofar as possible the weapon is preferably to have the same weight and weight distribution after the conversion as before. Consequently, in converting to the lower caliber, it is only the energy difference that affects the amount of buck and hence the amount of displacement needed to compensate for that different amount of buck.

It might also be expected that because of the lesser energy produced in firing the .22 cartridge, the displacement already provided in the initial design of the Colt .45 would be too large, since the sighting adjustment used to compensate for that original displacement would have been based on the larger energy generated in firing the .45 cartridge, and a part of the compensation for that higher energy, which would have made the actual bore axis point to a point on a target that was some distance lower than the point seen through the sights, would have to be "retracted"—i.e., the muzzle end of axis C would need to be higher than the muzzle end of axis B. Given that the sighting of the weapon has already been adjusted so as to view a target at a lower point than that at which axis A actually points, one would assume that either the sighting would need to be changed in the course of converting the weapon or the axis would need to be moved an amount between the aim point and the actual firing axis that is less than that of the original Colt .45. In such a case, axis C would need to diverge upward from the point of origin of the B axis at the breech end, since it is along axis C that the bullet will actually proceed. However, that also turns out not to be the case, because of yet one more factor that derives from a difference in the action of the weapon, and specifically slide 18, when converted by the invention as compared to the action of the original Colt .45.

As established by that original design, when the weapon is in firing condition with the breech closed, the breech end of barrel 14 will have been elevated so as to bring locking lugs 16 on top of barrel 14 into engagement with slide grooves 40 on top of slide 18. That leaves the bore axis A pointing downward at the outset, and the sights are set accordingly, but there is yet another effect occurs that must also be taken into account. As has been noted, in the present conversion the original Colt .45 slide 18 is retained but the Colt barrel 14 is replaced by conversion barrel 102. Even though slide 18 is retained, however, the specific action of slide 18 is substantially altered. In the Colt .45, as slide 18 recoils, the breech face 38 end of barrel 14 is pulled downward by pivot link 56 beneath barrel 14 as barrel 14 moves rearward, which action disengages locking lugs 16 from slide 18 and allows slide 18 to continue on rearward to eject and chamber a new cartridge. In this unlocked position, axis A of barrel 14 becomes essentially parallel to the surface of frame 12 along which slide 18 recoils, so that barrel 14 and slide 18 can freely slide over frame 12.

By contrast, in the present conversion the outer diameter of barrel 102 always remains in the position, in terms of the location of the central axis of barrel 102 (not axis C of the bore), that is the same as that reached in the Colt .45 in the recoil just described, i.e., in that "unlocked" position. Consequently, with reference to carrying out the present conversion barrel 102 does not start out in a downwardly divergent position when in the firing position as is the case with the Colt .45. That circumstance as to barrel 102 is contrary to the premise on which the original sighting is set on the Colt .45, i.e., that which is intended to account not for the buck but rather for the downward orientation of axis A as a result of the action of slide 18. What would appear to require a compensating upward adjustment in the orientation of axis A but which is actually accomplished by an adjustment in the sighting is thus not required in the present conversion, since slide 18 in the converted weapon does not undergo the same action as slide 18 does in the original .45 caliber pistol—it does not start out pointing downward, but is level at the outset. It thus becomes necessary to "reverse" that original compensation by a downward divergence in axis C.

It is also recognized that .22 Short, .22 Long, and .22 Long Rifle cartridges will have different sighting characteristics, since the different amounts of powder in the cartridge will yield different amounts of energy and hence different amounts of buck. The different sizes (masses) of the bullets also affect the bullet muzzle velocities, but have no effect on the buck. Also, variations in the quality of the cartridges used have yielded muzzle velocity variations of as much as 300 ft/sec. Conversion kit 100 must then be based upon a single one of those cartridge types. With that energy difference in mind, and the need to ensure that the cartridge used will be powerful enough to move the heavy .45 parts, the angle at which axis C is made to diverge from axis A was based on the use of the more powerful .22 Long Rifle ammunition.

The invention thus inclines the bore axis, i.e., axis C, at an angle that diverges downwardly (in proceeding from the breech to the muzzle) from the central axis of barrel 102 in an amount that will take account both of the difference in the magnitude of charge in the .22 cartridge as opposed to the .45 cartridge and the difference in mode of operation of slide 18, by using a small downward divergence angle of approximately ¼° (0.25 degree). That initial divergence will no longer be present at the end of the recoil or buck process, and the original target sighting and the bullet trajectory will coincide at a common point at a target, thereby to preserve the original sighting, even though the sight line would be "uphill" at the time of bullet impact as a result of that recoil or buck.

Considering now the extraction process that removes spent cartridges from chamber 110 of gas piston 108, the especially relevant parts of this conversion kit are piston groove 112, extractor 116, extractor claw 118, and extractor lugs 120. The extractor of the original Colt .45 must be replaced in converting to the use of .22 caliber ammunition for two reasons: the different size of the cartridges and the fact that .22 caliber cartridges are rim fire rather than center fire. (The .22 cartridge is too small to be grasped by the original Colt .45 extractor, and of course will be in a somewhat different location.) The present conversion, however, also provides another change in the manner of engaging the extractor with the moving breech block of the weapon, i.e., through the use of a sliding extractor. The term "breech block" is often broadly defined to mean all of the components of a firearm that serve to close the breech end of the barrel, thus to retain the cartridge within the chamber for firing and to confine the forces produced by firing. As treated here, however, this structure is described in more specific terms that refer only to the slide 18 and breech face 38 portions of the original Colt .45 that are left in place. Again, it is this sliding extractor feature that permits cartridge extraction to be carried out without replacing slide 18 of the Colt .45.

By this procedure, extractor 116 is first sized to fit the .22 caliber cartridge, and then is disposed at a location that is compatible both with that change in size and with the other differences in structure of the converted firearm. Specifically, extractor 116 incorporates extractor claw 118 and extractor lugs 120 that are disposed so as to match the different configuration of the modified weapon, i.e., extractor claw 118 is located differently from both the Colt .45 and the Williams '657 extraction mechanisms, and extractor lugs 120 are a new feature provided by the invention. These differences relate principally to the different caliber bore in barrel 102 and the different bore axis therein, as has been discussed above.

The second major difference in the extraction mechanism relates to the method of engagement of the extraction mechanism with the breech block (as defined above). In the original Colt .45, extraction is brought about by a hook attached to slide 18, which can be seen as extractor "f" at the top of FIG. 4 in the Browning '924 patent, and is discussed in Browning '924 on p. 4, left side, lines 28–33. In the present conversion that original hook is left intact—although it does nothing for, it also does not interfere with, the operation of the weapon as converted in the present invention. In the Williams '657 conversion, the entire slide 18 is replaced, while in this invention, as can best be seen in FIG. 6 and particularly by the dashed line near the top thereof that leads from extractor 116 and gas piston 108 to barrel groove 106, extractor 116, with extractor claw 118 and extractor lugs 120, goes first into piston groove 112 above chamber 110 in gas piston 108, and then into barrel groove 106 on top of barrel 102. That structure provides the aforementioned "sliding" extractor mechanism, which obviates the need to replace the original Colt .45 slide 18. Only the extractor mechanism then needs to slide, and the grooves through which that slide action takes place is provided by cutting out piston groove 112 in gas piston 108 and barrel groove 106 in barrel 102.

The changes brought about by the sliding extractor aspect of the invention as just discussed will now be noted with reference to FIGS. 7–9. FIG. 7 is a cutaway side elevation view of a .45 caliber pistol converted to .22 caliber in accordance with the invention, made especially to set out more clearly the relative disposition of the parts here involved than is done in the exploded view of FIG. 6 (and at the same time to show the location of toroidal groove 160 that will be discussed below); FIG. 8 is a partially cutaway side elevation view of a .45 caliber pistol as converted to .22 caliber by the procedure of the Williams '657 conversion kit; and FIG. 9 is a partially cutaway side elevation view of a .45 caliber pistol that has been converted to .22 caliber by the procedure of the present invention. The distinction between these two methods becomes evident by first obtaining a clear image of the locations of these parts from FIG. 7, and then by a side-by-side comparison of the different parts involved by way of FIGS. 8, 9.

In FIG. 7 especially, it can be seen that the parts bearing numbers above 100 and hence are parts of conversion kit 100 have been nicely fit within the original Colt .45 framework. (The weapon has been thoroughly restructured using a number of modifications, but yet retains the more expensive original Colt parts and hence is done at less cost than that of the Williams '657 conversion. FIG. 8 shows a new extractor 74 and new slide 78 in the Williams '657 conversion, while the invention requires only a new extractor mechanism that itself assumes the sliding role necessary for cartridges to be extracted and ejected, and to have new cartridges loaded. FIG. 9 shows the parts of the original .45 that are retained in the invention, which (besides frame 12) include slide 18 and slide grooves 40. The principal contrasts between the Williams '657 and the present method can be summarized as follows:

1) Slide 18 of the original weapon is removed by Williams '657 and replaced with slide 78 as shown in FIG. 8, but is left in place in the invention as shown in FIG. 9.
2) Slide grooves 40 of the original weapon are removed by Williams '657 in the removal of slide 18 and replacement with slide 78 as just noted, but again are still present in the invention as shown in FIG. 9. For reasons of cost, the invention seeks to retain as much of the original .45 caliber parts as possible, and slide grooves 40 serve in the firearm that has been converted by the invention to provide a means of mechanical connection between slide 18 extractor 116, thus causing extractor 116 to reciprocate in unison with slide 18 during the course of a firing cycle.
3) Extractor 74 in the Williams '657-converted weapon shown in FIG. 8 represents a distinctly different conversion procedure than is exhibited by extractor 116, extractor claw 118, and extractor lugs 120 of the invention as shown in FIG. 9.

Although as previously mentioned the parts involved in the Williams '657 conversion have been designated here in rather broad terms, thus to make a rather shorter "Williams '657 Conversion" parts list as compared to that of the "Present Conversion" list in Table I, it should still be evident that the ability to avoid replacing slide 18 in the present conversion leads to a much more simple, and significantly less expensive, conversion process.

It should also be noted that in minimizing the number of original Colt .45 parts that have to be removed and replaced with the parts of conversion kit 100 makes for a much more convenient kit. Carrying out the conversion leaves only the Colt .45 barrel and magazine to be preserved upon needing to revert back to firing .45 caliber ammunition when assuming duties back in the field, and the whole kit itself will fit into a standard two-pocket magazine pouch.

Now as to the magazine embodied in magazine assembly 140, although this aspect of the invention is quite simple to use—it is simply installed in the original Colt .45 magazine well 48—the manner of operation differs substantially from the prior art and requires a more detailed explanation. Magazine assembly 140 is unique in playing a role in the cartridge extraction process, as will now be explained with reference to FIGS. 16–24, which collectively show magazine assembly 140 as a whole, magazine body 122, floor plate 126, magazine filler 128, follower 130, thumb button 132, magazine spring 134, spring guide 136, feed ramp 138, asymmetric feed lip 142, ejector shoulder 144, control lip 146, magazine filler top lip 148, cartridge rim body ramp 150, cartridge rim filler ramp 152, alignment ramp 154, floor plate retaining lips 156, and slide stop actuator 158. Certain ones of the afore-listed parts are also shown in FIG. 6, together with other parts of conversion kit 100, and also magazine filler 128, magazine assembly 140, asymmetric feed lip 142, ejector shoulder 144, and control lip 146 are shown again in FIG. 27, along with the original Colt .45 slide 18, breech face 38, and depending rib 54.

Except for participating in the cartridge extraction process, magazine body 122 is conventional in form other than by the fact that the cartridge space is tapered to be smaller in the direction of the cartridge axis towards the muzzle, and being sized to accommodate .22 caliber cartridges, and floor plate 126 is similarly shaped. Magazine filler 128 fills up space that without the conversion would have been filled by the larger .45 caliber cartridge, thus to position the smaller .22 caliber cartridge properly in dividing the cavity within magazine body 122 so as to provide an area of appropriate size within which the smaller .22 caliber cartridges will be narrowly confined to the leftward side (looking down the weapon toward the muzzle) of the magazine, while allowing the exterior dimensions of magazine body 122 to remain those of the original magazine and thus fit properly within magazine well 48. Magazine filler 128, besides providing a mounting point for feed ramp 138, contains magazine filler top lip 148 that cooperates with asymmetric feed lip 142 and cartridge rim filler ramp 152 to help lift the rear of the cartridge up to more near the bore axis during the process of feeding cartridges. The tapering of the cartridge space just noted ends near the top of magazine body 122, however, where magazine filler 128 is ramped by alignment ramp 154 so that the small upper portion of magazine filler 128 adjacent to magazine filler top lip 142 will be generally parallel to the side of magazine body 122 and asymmetric feed lip 142. The asymmetry of asymmetric feed lip 142 serves to allow a blunt breech face, i.e., the Colt .45 breech face 38, to extract the smaller .22 caliber cartridge, but otherwise asymmetric feed lip 142 serves in the usual manner to keep the remaining cartridges within magazine body 122, a function carried out in the Williams '657 conversion by feed lips 92.

Figure 21:
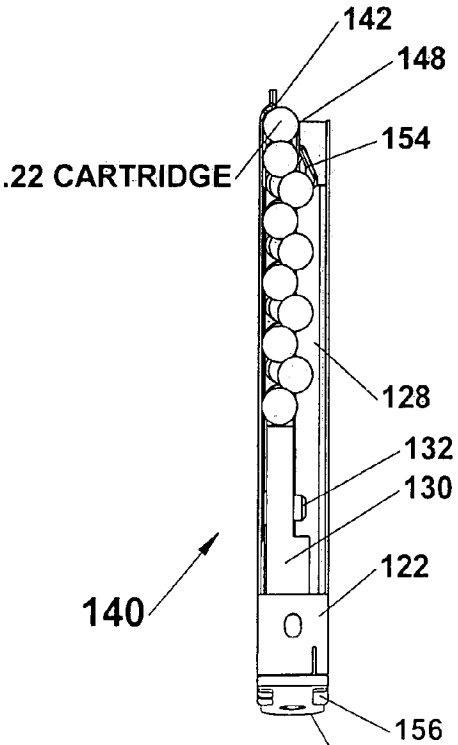
FIG. 21 is a rear elevation view of the magazine assembly of FIGS. 16–20, again partially cut away to show the staggered alignment of the rim ends of the cartridges.
Figure 20:
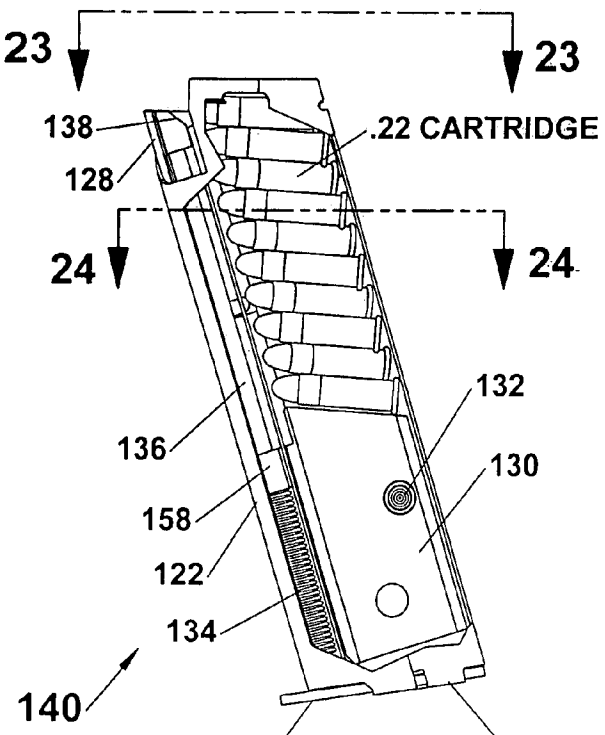
FIG. 20 is a left side elevation view of the magazine assembly of FIGS. 16–19, partially cut away to show the manner of holding cartridges.

Follower 130 is placed inside the area confined by magazine filler 128 and is able to slide in a more or less vertical direction within that area. As can be seen by comparing FIGS. 20 and 21, follower 130 is rectangular in cross-section, with an end surface in contact with the lowest of the loaded cartridges, thereby to "follow" those cartridges as they move upward, and indeed to cause that upward motion under the influence of magazine spring 134 as the top cartridges are successively loaded into chamber 110 and then fired and ejected. As best seen in FIGS. 19 and 21, at the upper end thereof follower 130 has a lateral extension, slide stop actuator 158, that extends towards the front of magazine body 122 so as be disposed ahead of the leading, upward end of magazine spring 134, which itself is placed concentrically around spring guide 136. The role of slide stop actuator 158 is to come into contact with slide stop 20 upon exhaustion of all of the cartridges, as will be explained below. Slide stop actuator 158 is structured as a tube so as to allow spring guide 136 to pass therethrough. As best seen in FIG. 20, follower 130 includes a small, circular hole to accommodate thumb button 132 wherein thumb button 132 is exposed externally by way of a slot in magazine body 122. Thumb button 132 moves along that slot as cartridges are added to or removed from the magazine.

Feed ramp 138, which is rigidly mounted to the upper end of magazine filler 130, is placed within magazine assembly 140 to function in place of feed ramp 50 of the Colt .45 because the original feed ramp 50 in frame 12 is improperly disposed to function with the smaller .22 caliber cartridge and relocated bore. Ejector shoulder 144 has been added to the end of asymmetric feed lip 142, as a part of magazine assembly 140, in order to cause the extracted cartridge to be expelled from the gun. Control lip 146 is that part of asymmetric feed lip 142 that keeps the spent cartridge case in engagement with extractor 116, and particularly with extractor claw 118, as that case is being pulled out of the chamber. The distinction between asymmetric feed lip 142, ejector shoulder 144, and control lip 146 is best seen in FIG. 19, although the placement of ejector shoulder 144 parallel to control lip 146 and above asymmetric feed lip 142 so as to "catch" the cartridge being extracted is also seen in FIG. 17.

Figure 22:
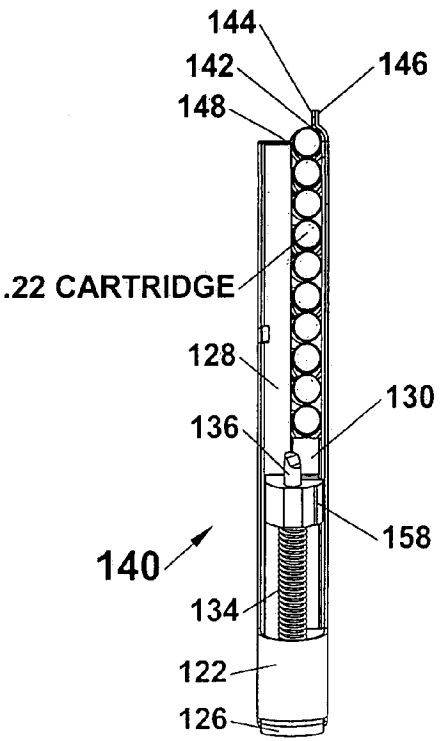
FIG. 22 is a front elevation view of the magazine assembly of FIGS. 16–21, again partially cut away to show the straight alignment of the nose ends of the cartridges.

The operation of magazine assembly 140 can be seen in the method of loading cartridges into the space defined by magazine filler 128. Follower 130 is depressed against magazine spring 134 by sliding thumb button 132 towards floor plate 126. As follower 130 is depressed, a cartridge is inserted rim first into the front of magazine assembly 140 to the point where the cartridge resides beneath asymmetric feed lip 142, which process can be continued until that space is filled. Magazine 140 when so filled with cartridges is shown in FIGS. 20–24, wherein the rim ends of the cartridges are in a staggered column except right at the top, as shown in FIG. 21, but lay in a straight vertical line as shown in FIG. 22 at the nose end. That column is pressed upward by follower 130, arising from the magazine spring 134, which would have been depressed in the cartridge loading process, pressing against asymmetric feed lip 142. The cartridges are maintained below asymmetric feed lip 142 by the presence of magazine filler top lip 148, as seen in FIGS. 21, 22.

The inclined top surface of follower 130 causes the cartridges to be stacked such that the rim of the top cartridge is forward of the rim of the cartridge just beneath that top cartridge. Because the confined space occupied by that column of cartridges is tapered as noted above, the rims of the cartridges have a wider space available than do the cartridge noses. As a result, the larger diameter rims can be staggered as noted above and shown in FIG. 21, while the noses of the cartridges remain in a straight column. That alternate stacking allows the horizontal axes of the cartridges to remain roughly parallel rather than have each cartridge progressively more angled as the wider rim ends were stacked one after the other in a straight line. The rim ends of the top two cartridges below asymmetric feed lip 142 are then forced into a straight vertical alignment through the action of alignment ramp 154, as is also shown in FIG. 21. As the cartridges are expended and ultimately ejected, each successive cartridge that follows in the stack is moved up and into the parallel alignment exhibited by the top two cartridges in FIG. 21.

Figure 27:
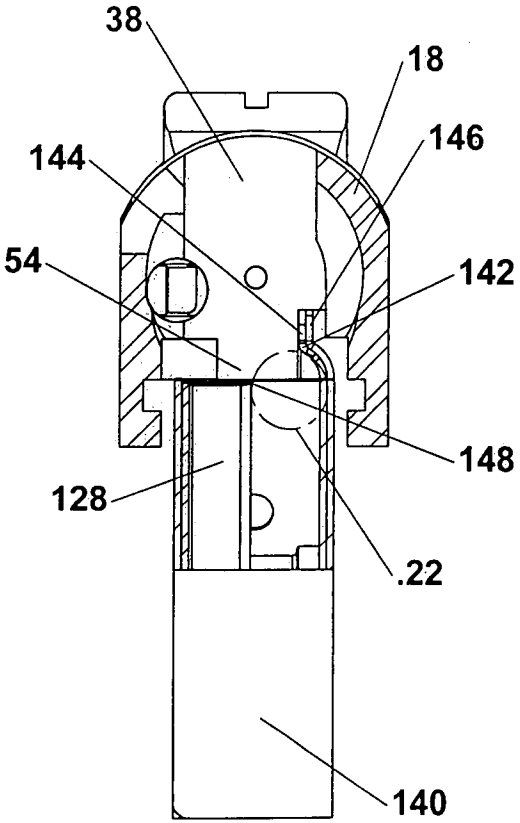
FIG. 27 is a cross-sectional view similar to those of FIGS. 25, 26, looking toward the muzzle of a .45 caliber pistol as converted to .22 caliber by conversion kit 100, including a dashed profile of a .22 caliber cartridge and particularly showing certain parts of the original .45 caliber pistol that are retained in that conversion.

As can be seen in FIG. 27, when the loaded magazine is placed into the weapon, follower 130 presses the column of cartridges upward against depending rib 54 under slide 18 of the original Colt .45, depending rib 54 being a downward extension of breech face 38. When slide 18 is then retracted to load the first cartridge, follower 130 raises the column of cartridges until the next cartridge in the magazine comes up against asymmetric feed lip 142. That new top cartridge then has a clear path to slide 18. As slide 18 then moves forward, the corner of depending rib 54 encounters the base (rim) of that top cartridge which is then likewise caused to move forward. As the cartridge moves forward, the nose of the cartridge will encounter the inclined surface of feed ramp 138, as can be seen in FIGS. 19, 20, thus placing the cartridge in proper alignment to enter into chamber 110. After moving forward a short distance, the rim of the cartridge passes out from under asymmetrical feed lip 142 so as to come into contact with two parallel inclined surfaces, which are (1) the cartridge rim body ramp 150 and (2) the cartridge rim filler ramp 152. That forward motion also causes the rim end of the cartridge to rise towards alignment with chamber 110, so that continued forward motion will place the cartridge fully within chamber 110.

Upon firing the cartridge, slide 18 will begin to move rearward, extractor claw 118 of extractor 116 engages the rim of the spent cartridge which starts to withdraw that cartridge from chamber 110. In the Williams '657 conversion, the cartridge rim is closely held in a shallow counterbore in breech face 88, which prevents that cartridge rim from moving to the side so as to disengage from extractor 74. Since that counterbore is lacking in the original slide 18 that the present conversion continues to employ, other means from preventing that kind of sideways motion must be employed in the present conversion. That role is filled by control lip 146. As a spent cartridge case moves rearward as a result of the action of extractor claw 118, that cartridge case passes closely alongside control lip 146, which is approximately diametrically opposed to extractor claw 118, thereby being held in engagement with extractor claw 118 until the extraction is completed.

At a certain point in that rearward motion, however, the bottom of the rim of the cartridge being extracted will come into contact with ejector shoulder 144 that is a part of magazine assembly 140. The rim of the cartridge having encountered an obstruction (ejector shoulder 144) at just one point, a rotational moment is produced that causes the open end of that cartridge case to rotate upward and to the right (as seen by the user), thereby to be expelled from the weapon. As slide 118 continues rearward, depending rib 54 will reach a point at which the stacked cartridges are exposed, and then being free to do so, the topmost of those cartridges will rise up to the top of the magazine, under the influence of follower 130 and magazine spring 134, and a "reload" of a cartridge will take place as before. This entire, cyclical process will repeat until the magazine has been emptied of cartridges.

After the last cartridge has been fed out of the magazine, follower 130 rises until slide stop actuator 158 comes into contact with and exerts pressure on slide stop tang 36 of the original Colt .45, which extends into magazine well 48 through slide stop hole 42. As can be seen in FIG. 20, that contact would not have been possible so long as there remained any cartridges within the space defined for those cartridges by magazine filler 128, since the upward movement of follower 130 would be blocked by any intervening cartridges. As slide 18 travels rearward upon the last cartridge in chamber 110 being fired, slide stop notch 56 passes over slide stop tang 36. Again because there is no cartridge present, once slide stop notch 56 is so located, slide stop tang 36 is free to move up into slide stop notch 56 under the influence of slide stop actuator 158, which automatically locks slide 18 into this retracted position. When an empty magazine assembly 140 is removed and a magazine assembly 140 containing cartridges is installed in magazine well 48, slide stop tang 36 is manually depressed out of engagement with slide stop notch 56. By so doing, slide 18 is then free to travel forward under the influence of recoil spring 24, which action will chamber the top cartridge in magazine assembly 140 and a new firing sequence can commence.

Another of the improvements embodied in the present invention is carried out in the context of what is here called the "coaxial gas piston" method (or "floating chamber" in the Williams '657 terminology), which may also be termed the "gas pressure" method, the use of which is advantageously retained in the invention. Retention of that method is another means that will allow conversion to the lower caliber with a minimum of replacement parts and cost. What is new and unique here in this respect is the manner in which provision is made to continue the use of that method in spite of the change in the barrel axis.

With reference to the Williams '657 patent conversion method, the use of the term "coaxial gas piston" means that the piston is coaxial with the axis of the bore in the barrel, and that bore is coaxial with a central axis of the outer diameter (OD) of the barrel. In the present conversion, the bore of barrel 102 is made to be divergent from the OD of the barrel rather than coaxial, but the gas piston still remains generally coaxial with the bore, hence that piston thereby becomes eccentric from the OD of the barrel. The function performed by that piston in the Williams conversion is that of increasing the gas pressure on the breech block, or specifically breech face 36, and is still performed in the present conversion. In brief, the present conversion manages to place the rim of the smaller .22 cartridge in alignment with the original firing pin 66 while not sacrificing the advantage of greater recoil energy. What does that specifically is the relocation of the bore to an off-center position. The basic motivation that underlies the invention was the development of a less expensive conversion to .22 caliber in which the original Colt .45 slide 18 could be retained, thus avoiding the replacement of this complex and expensive part as is required by the Williams '657 conversion. By continuing to use the coaxial gas piston method, even in the context of the other changes imposed by the conversion, the advantage obtained lies in the provision of sufficient power to move the heavy Colt .45 parts with only the force of the less powerful .22 cartridge.

Another aspect of the invention is found in the provision of toroidal groove 160. In the use of the coaxial gas piston method, in the Williams '657 conversion an enduring problem has been the accumulation of combustion products as well as lead and powder residue from the firing of cartridges at the interface between the end face of gas piston 108 and the opposing rearward face of barrel 102. As can be seen in FIG. 7, that region will be exposed to high pressure gas upon each firing, and each firing will convey more of such unwanted materials into that region. As a result, that residue will become packed into a washer-like shape between those two faces that will prevent the gas piston 108 from properly seating itself against that end face of barrel 102, eventually shortening the stroke of gas piston 108 to the point of no longer functioning. This result has been found to appear after as few as 50 firings. The solution to that problem turns out to lie not in eliminating the combustion products and residue, which is not possible, but rather in both cleaning off those materials and providing somewhere else for those materials to go.

Specifically, toroidal groove 160 is provided in a toroidal or "doughnut" shape around the end face of gas piston 108 by machining. The periphery or outer leading edge of gas piston 108 is then seen to constitute a convenient and relatively sharp "scraper" that will remove significant amounts of accumulated fouling from the wall inside the barrel, and then draw that material radially inward. Instead of having a "wafer" of fixed fouling materials on the facing end of gas piston 108 as had been found before toroidal groove 160 was formed, those materials were seen to have been broken up so as to be at least partially aspirated out of the bore by subsequent firings. The effectiveness of this "self-cleaning" process, as brought about by the presence of toroidal groove 160, was tested in a 250-shot sequence, after which the weapon was found to fire as readily and properly as at the beginning of the test.

Figure 26:
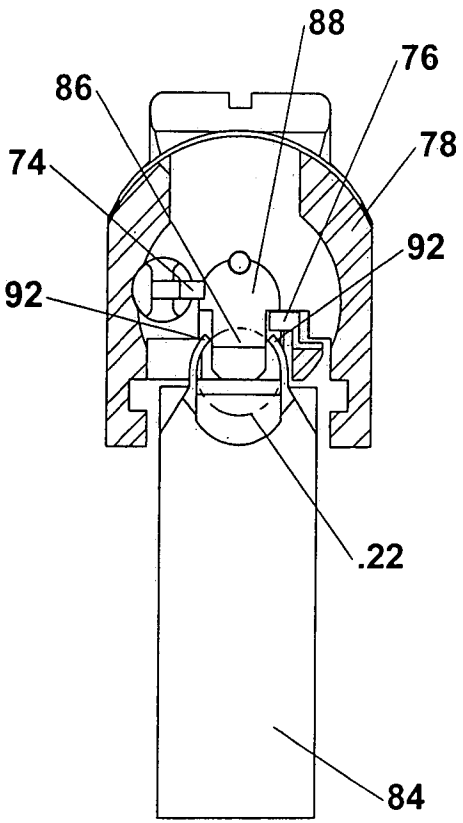
Fig. 26 Prior Art
FIG. 26 from the prior art is a view in cross-section, similar to the view of FIG. 25 looking toward the muzzle, of a .45 caliber pistol converted to .22 caliber by the Williams '657 procedure, including a dashed profile of a .22 caliber cartridge.
Figure 25:
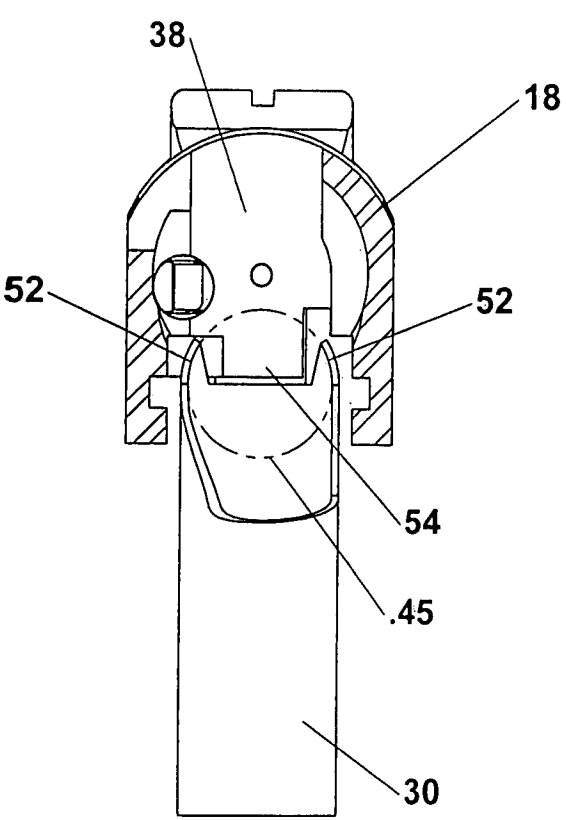
Fig. 25 Prior Art
FIG. 25 from the prior art shows in cross-section, looking toward the muzzle, the original Colt .45 caliber pistol including a dashed profile of a .45 caliber cartridge.

As a last illustration of the processes of conversion kit 100, FIGS. 25–27 respectively show the profiles of the .45 cartridge in the original Colt weapon, that of the .22 cartridge as a result of the Williams '657 conversion, and the .22 profile in the present conversion, where the dashed circles represent the cartridge profiles, and except for the Colt slide 18, breech face 38, and depending rib 54 in FIG. 27 for the present conversion, the numbered elements in each figure pertain only to that particular original firearm or conversion and have previously been discussed. These figures, however, do bring out another distinct difference between the present conversion kit 100 and that of Williams '657, which of course is the placement of the cartridge. After applying conversion kit 100, the rim end of the .22 cartridge will be seen (e.g., in FIG. 27) to be rightward of and below both the A axis of the original Colt .45 and the cartridge axis of the Williams '657 conversion.

The specific apparatus and procedures set forth above are of course exemplary only, and not limiting, and as has been indicated, any specific embodiment of the invention, or such variations therefrom as would be obvious to a person of ordinary skill in the art, must also be taken to be encompassed by the invention, which is to be interpreted and construed only in light of the following claims.

I claim:

1. A conversion kit for modifying the structure of an original, self-loading handgun whereby cartridges of a caliber different from that for which said self-loading handgun was constructed can be fired accurately by such a modified self-loading handgun, comprising:

a replacement barrel sized to accommodate the smaller caliber bullet, wherein said replacement barrel further comprises:

an offset bore that is non-concentric, divergent, and angled downward, whereby the rim of an installed cartridge will be positioned so as to be properly struck by the firing pin of said original handgun while still being directed to the same firing point as said original handgun;

a longitudinal slot along the top of said barrel in order to accommodate a sliding extractor disposed therein;

a sliding extractor disposed within said longitudinal slot having a large depending rib for removing an expended cartridge, further comprising a claw to engage the rim of a fired cartridge and one or more lugs disposed thereon to engage said longitudinal slot in order that said extractor will move in conjunction with said longitudinal slot;

a gas piston disposed in a cooperative relationship with said sliding extractor, thereby to develop an increased force capable of moving heavier sliding extractor, that will be heavier than the extractor of the original handgun; and a replacement magazine sized to accommodate the smaller cartridge and having a ramped surface and tapered cavity whereby a mutual alignment of added cartridges can be maintained, and an asymmetrical feed lip in order both to accommodate said larger depending rib of said extractor and to serve as an ejector of the spent case.

2. The conversion kit of claim 1 wherein said gas piston further comprises a toroidal groove at the leading area thereof in order to remove fouling material on the interface of said gas piston.

* * * * *